US010858084B1

(12) United States Patent
Harlow et al.

(10) Patent No.: US 10,858,084 B1
(45) Date of Patent: Dec. 8, 2020

(54) RAFT CARRYING CASE

(71) Applicant: Air Cruisers Company, LLC, Wall Township, NJ (US)

(72) Inventors: Andrew Mahlon Harlow, Brick, NJ (US); Robert Host, Morganville, NJ (US); Whitney Bender, East Brunswick, NJ (US); Raphael Petit, Neptune, NJ (US)

(73) Assignee: Air Cruisers Company, LLC, Wall Township, NJ (US)

( * ) Notice: Subject to any disclaimer, the term of this patent is extended or adjusted under 35 U.S.C. 154(b) by 44 days.

(21) Appl. No.: 15/969,949

(22) Filed: May 3, 2018

Related U.S. Application Data

(60) Provisional application No. 62/503,002, filed on May 8, 2017.

(51) Int. Cl.
*B63C 9/04* (2006.01)
*B63C 9/00* (2006.01)

(52) U.S. Cl.
CPC ..... *B63C 9/04* (2013.01); *B63C 2009/0094* (2013.01); *B63C 2009/042* (2013.01)

(58) Field of Classification Search
CPC ..... B63C 9/04; B63C 2009/0094; B63C 2009/0017; B63C 9/08; B63C 9/065; B63C 9/21
USPC ..... 206/223; 441/41, 80, 84
See application file for complete search history.

(56) References Cited

U.S. PATENT DOCUMENTS 5,342,230 A * 8/1994 Louis ..... B63C 9/22 114/366
5,374,211 A * 12/1994 Imazato ..... B63C 9/02 441/84
6,394,867 B1 * 5/2002 Bianco ..... B63C 9/04 114/360
6,502,676 B2 * 1/2003 Dexheimer ..... A45C 5/14 150/111
6,520,327 B1 * 2/2003 Boardman ..... A45C 7/0086 206/315.4
9,162,738 B1 * 10/2015 Faletra ..... B63B 7/08
9,944,368 B1 * 4/2018 Faletra ..... B63C 9/04
10,435,124 B1 * 10/2019 Haynes ..... B63C 9/23
2003/0042157 A1 * 3/2003 Mays ..... A45C 13/02 206/315.1
2003/0106155 A1 * 6/2003 Arai ..... A61G 1/00 5/627
2007/0131686 A1 * 6/2007 Weast ..... F25D 3/08 220/212
2008/0121554 A1 * 5/2008 Townsend ..... A45C 5/02 206/570
2008/0280516 A1 * 11/2008 Rayles ..... B63C 9/065 441/80
2008/0299850 A1 * 12/2008 Larochelle ..... B63C 9/04 441/39
2010/0299837 A1 * 12/2010 Yandle ..... A61G 1/013 5/627

(Continued)

*Primary Examiner* — Chun Hoi Cheung
(74) *Attorney, Agent, or Firm* — Kilpatrick Townsend & Stockton LLP

(57) ABSTRACT

Embodiments of the present disclosure relate generally to a raft carrying case that allows deployment of a life raft while also securing a survival kit for access by the life raft passengers. The case includes two parts, a detachable survival kit and a raft enclosure portion.

16 Claims, 3 Drawing Sheets

(56) References Cited

U.S. PATENT DOCUMENTS

| | | | | |
|---|---|---|---|---|
| 2014/0103081 | A1* | 4/2014 | Alsaffar | A45F 4/02 224/154 |
| 2014/0256199 | A1* | 9/2014 | Tatum | B63C 9/04 441/84 |
| 2015/0197323 | A1* | 7/2015 | Cerdas | B63C 9/04 441/40 |
| 2016/0046355 | A1* | 2/2016 | Faletra | B63C 9/04 441/41 |
| 2017/0106953 | A1* | 4/2017 | Cole | A62B 99/00 |

* cited by examiner

RAFT CARRYING CASE

CROSS REFERENCE TO RELATED APPLICATIONS

This application claims the benefit of U.S. Provisional Application Ser. No. 62/503,002, filed May 8, 2017, titled "Raft Carrying Case," the entire contents of which are hereby incorporated by reference.

FIELD OF THE DISCLOSURE

Embodiments of the present disclosure relate generally to a raft carrying case that allows deployment of an inflatable life raft while also securing a survival kit for access by the life raft passengers. The case includes two parts, a detachable survival kit and a raft enclosure portion.

BACKGROUND

Current federal aviation regulations require that aircraft traveling over water for more than fifty nautical miles from the nearest shore must be equipped with a life preserver or approved flotation device for each occupant of the aircraft. Small planes and jets that fly over water often feature an onboard inflatable life raft that is packed in a compact and portable carrying case. The life raft may be moved on and off of the plane or jet. When the life raft is not on board the plane, it should be designed such that it may be transported and stored easily. When the life raft is needed on board, the life raft packaged in a carrying case is carried from storage to the plane or jet.

The inflatable life raft is often packaged in either a rigid or flexible carrying case together with an inflation system and a survival kit. The survival kit may include an impermeable supply of water, provisions, an electronic locating transmitter (ELT) such as a beacon, medical necessities, and any other appropriate first aid or lifesaving items required. Traditionally, the survival kit has been contained within the carrying case. In instances when the survival kit has been secured outside the carrying case, means to attach it have involved tools, which are not always available or easy to use. In other instances, the survival kit has been secured outside the carrying case via cords that can become dangerous snag points.

When not being used in an emergency, access to the survival kit may be necessary in order to replace age-limited parts at regularly-scheduled maintenance intervals. It may also be desirable to have access to the ELT, in the event that it needs to be reprogrammed or exchanged. When the survival kit is packaged inside the carrying case, replacing or exchanging the materials can become a challenge. For example, replacement of components inside the survival kit often necessitates opening the raft carrying case and unpacking (and re-packing) the life raft, which can increase turnaround time. However, packaging the life raft and survival kit together in the carrying case can offer protection and an easy way to transport the raft from the stowage location or maintenance center back to the aircraft. Improvements to the inflatable life raft carrying cases are thus desirable.

BRIEF SUMMARY

Embodiments of this disclosure thus provide systems and methods for providing an easily accessible and detachable survival kit that externally mounts to the raft carrying case.

In certain examples, there is provided a carrying case system for a life raft, comprising: a raft enclosure portion and a survival kit, wherein the raft enclosure portion is configured to enclose a life raft and comprises a closure system that maintains the raft enclosure portion in a closed configuration until life raft deployment, wherein the raft enclosure portion further comprises a first tether securement point on an internal surface of the raft enclosure portion; wherein the life raft comprises a second tether securement point; and a tether secured to the first tether securement point and to the second tether securement point, wherein the survival kit is detachably secured to the raft enclosure portion.

It is possible for the survival kit to be zippered to the raft enclosure portion. One zipper portion generally traverses a perimeter of one end of the carrying case and another zipper portion generally traverses a perimeter of one end of the survival kit. In other examples, it is possible for the survival kit to be detachably secured to the raft enclosure portion via any combination of hooks, snaps, buckles, buttons, or hook and loop fasteners. In either example, the survival kit is directly secured to the raft enclosure portion, without requiring intervening or external ties or lines.

There is also provided a method for deploying a life raft, comprising: installing the carrying case system of any of the above-described examples on board an aircraft; deploying the life raft from the raft enclosure portion of the carrying case; using the tether to pull the carrying case into the deployed life raft; disconnecting the survival kit from the raft enclosure portion.

There is further provided a method for packing a life raft into a carrying case, comprising: providing a raft enclosure portion with a tether secured to an internal surface of the raft enclosure portion; securing the tether to the life raft; packing the life raft into the raft enclosure portion; and attaching a survival kit to the raft enclosure portion. In one example of this method, the survival kit may be attached to the raft enclosure portion by zippering the survival kit to the raft enclosure portion. One zipper portion generally traverses a perimeter of one end of the carrying case and another zipper portion generally traverses a perimeter of one end of the survival kit. In another example of this method, the survival kit may be detachably secured to the raft enclosure portion via any combination of hooks, snaps, buckles, buttons, or hook and loop fasteners. This method allows removal of the survival kit from the raft enclosure portion in order to check or replace one or more age limited parts contained within the survival kit. The survival kit can be attached to the raft enclosure portion at a later date than packing the life raft into the raft enclosure portion.

DETAILED DESCRIPTION

Embodiments of the present disclosure thus provide an inflatable life raft carrying case with an external and detachable survival kit. The raft carrying case has an internal attachment that secures the carrying case to the life raft. This results in no external attaching lines, clips, hooks, or other securement systems that may become potential snag points. In a specific example, the survival kit is attached to the life raft carrying case via a zippered connection. One zipper portion generally traverses a perimeter of one end of the carrying case and another zipper portion generally traverses a perimeter of one end of the survival kit. In other examples, the attachment may be via any combination of hooks, snaps, buckles, buttons, hook and loop fasteners, or any other appropriate fasteners that ensure a secure connection but that do not require specialized tools in order to remove the survival kit. It is generally desirable that removal be conducted manually/via hand. It is also generally desirable that the attachment not include any externally connected straps or lines. Because the survival kit is detachable, it is possible to provide easy access for reprogramming of the ELT or for replacement of any age-limited provisions contained therein. Additionally, because the survival kit need not be attached to the raft carrying case until shipping, the life raft portion may be packed and stored for a longer period of time. This results in ease of manufacturing and storing prior to shipping or sale.

Figure 1:
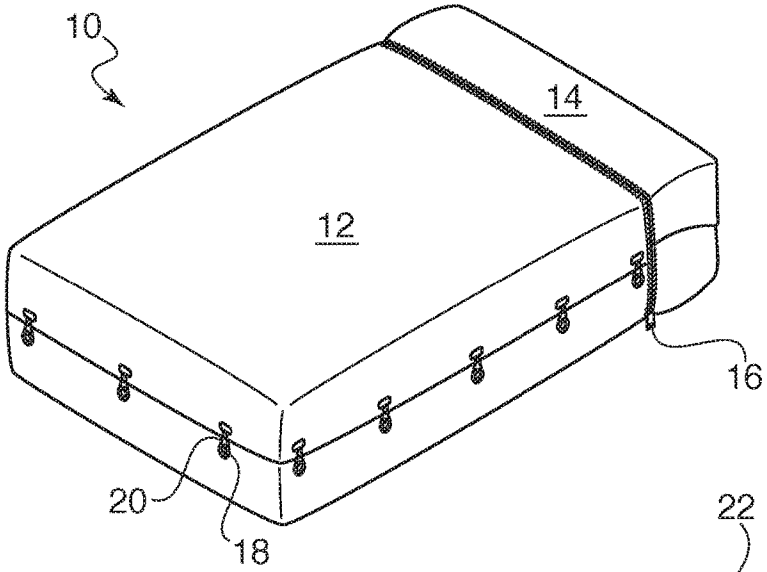
FIG. 1 shows a side perspective view of one embodiment of an inflatable life raft carrying case.

As illustrated by FIG. 1, the carrying case system 10 generally includes a raft enclosure portion 12 and a survival kit 14. As illustrated, these two portions may be cooperable via a zipper 16. A zipper 16 has been found to be particularly useful because it provides a stable connection, while also rendering the two portions 12, 14 easy to separate without tools or instructions required. Although a zippered connection is shown and described throughout this application, it should be understood that other connections are possible and considered within the scope of this disclosure. In one example, the connection may be via clips. In other examples, the connection may be via any combination of hooks, snaps, buckles, buttons, hook and loop fasteners, or any combination thereof. One benefit of using a zipper construction is that its use is universally understood. Another benefit of using a zipper construction is that it provides a rigid attachment that is predictable and continuous, leading to ease of carrying the carrying case system 10. Zippers allow for a relatively rigid connection between the carrying case and the survival kit, which is desirable for the end user. For example, rigidity makes transporting the carrying case to and from an aircraft easier. As shown, one zipper portion generally traverses the entire perimeter of one end of the carrying case and the other zipper portion generally traverses the entire perimeter of one end of the survival kit. The connection feature used should lend stability to the system 10, but also be easy to operate in order to separate the raft enclosure portion 12 from the survival kit 14 when needed.

As shown, the raft enclosure portion 12 may be a lacing cover with grommets 18 and laces 20. When the raft enclosure portion 12 is closed, the laces 18 are threaded into the grommets 20. When the life raft inflates, the closure is forced open due to inflation force. This is one common way to close the raft enclosure portion 12, but it should be understood that alternate closure options are possible and considered within the scope of this disclosure. For example, alternate closure options are shown and described in Applicant's co-pending application, U.S. Ser. No. 15/475,527 titled "Release System for Inflatable Life Saving Devices." In another example, the closure may be by force against a frangible cord. As a general matter, the raft enclosure portion may be a closure system that is opened by force, which is typically the inflation force of the inflating life raft.

Figure 2:
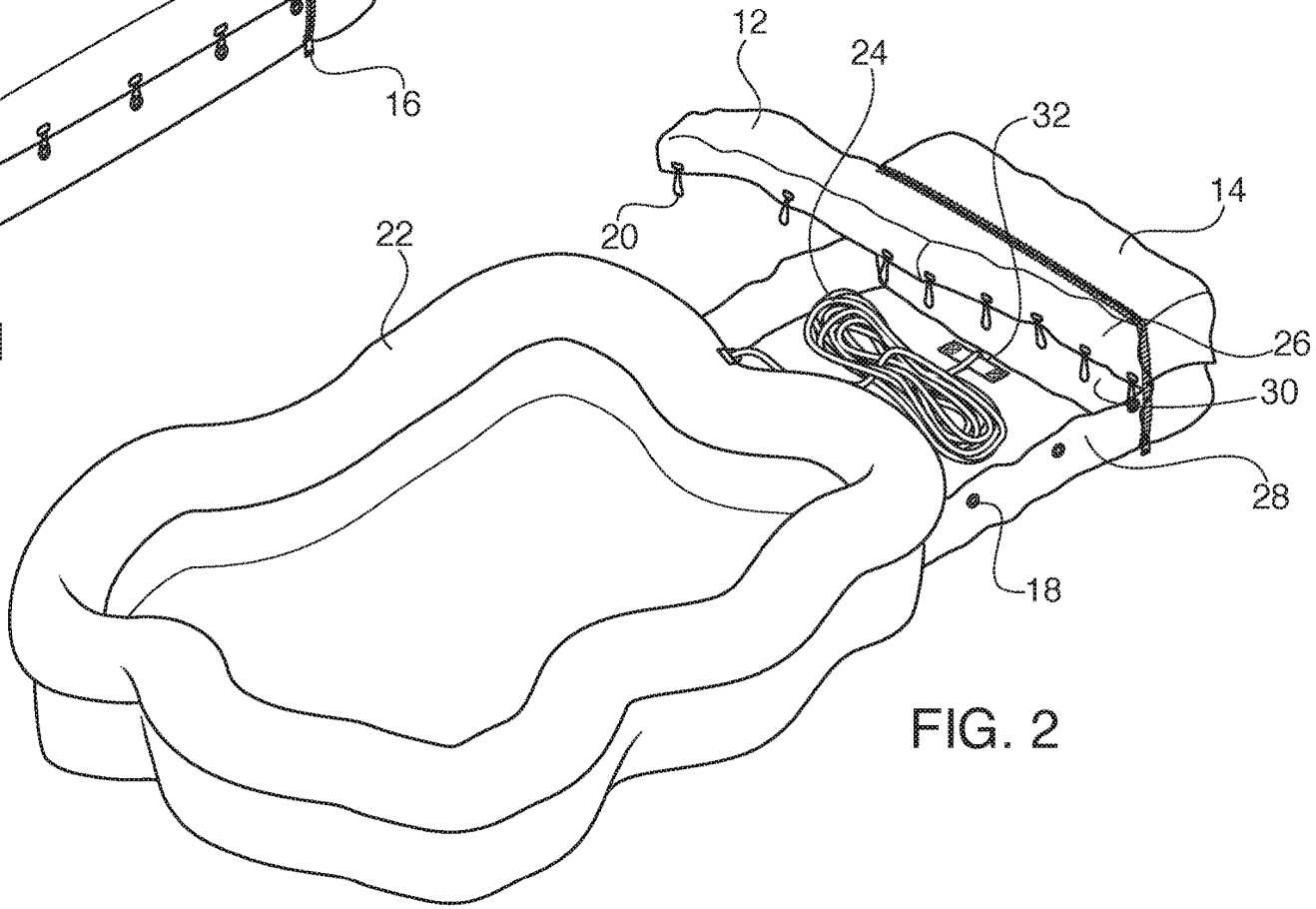
FIG. 2 shows a side perspective view of the carrying case of FIG. 1 with the raft enclosure portion opened and a life raft deploying therefrom.

As illustrated by FIG. 2, once the raft enclosure portion 12 is opened, the inflatable life raft 22 begins inflating and pushes its way out of the raft enclosure portion 12. A tether 24 is secured to the raft enclosure portion 12. The tether 24 may be a cord, a strap, a leash, a rope, or any other appropriate structure that can secure the life raft 22 to the life raft enclosure portion 12. In a specific example, the tether 24 may be a nylon-based woven cord or strap.

Figure 3:
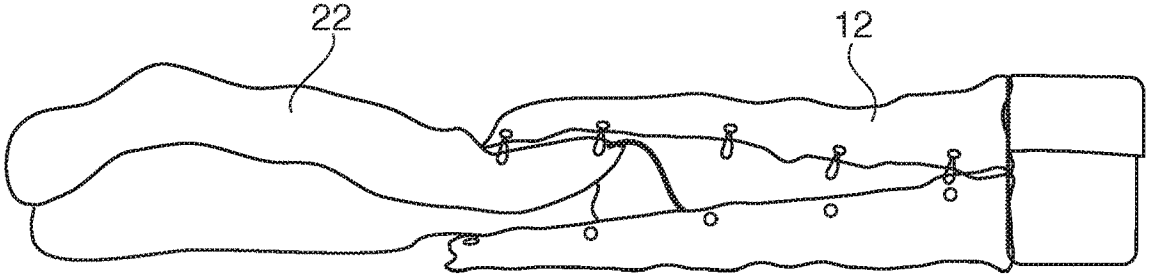
FIG. 3 shows a side perspective view of the process of FIG. 2.

It is possible for the tether 24 to be secured to either the top 26 or bottom 28 flap of the raft enclosure portion 12, or to the rear wall 30. The general intent is that the tether 24 is securely connected to the interior of the raft enclosure portion 12 at a first tether securement point 32. Securing the tether 24 to the interior of the raft enclosure portion 12 prevents it from becoming caught or tangled prior to deployment of the life raft 22. The tether 24 is not accessible externally until the raft enclosure portion 12 has opened and released the life raft 22. The first tether securement point 32 may be an internal loop that is stitched into one of the flaps of the raft enclosure portion 12. In other examples, the first tether securement point 32 may be a circular ring, a D-shaped ring, a snap, a hook, a grommet, a stitched cord, a hook and loop fastener, or any combination thereof. The tether 24 may be tied, looped, sewn, or otherwise secured with respect thereto. It is also desirable that the tether 24 be long enough to allow complete inflation of the life raft 22, while the raft carrying case system 10 (with both the raft enclosure portion 12 secured to the survival kit 14) trails behind. FIG. 3 illustrates a side view of the life raft 22 in the process of inflating and exiting the raft enclosure portion 12.

Figure 4:
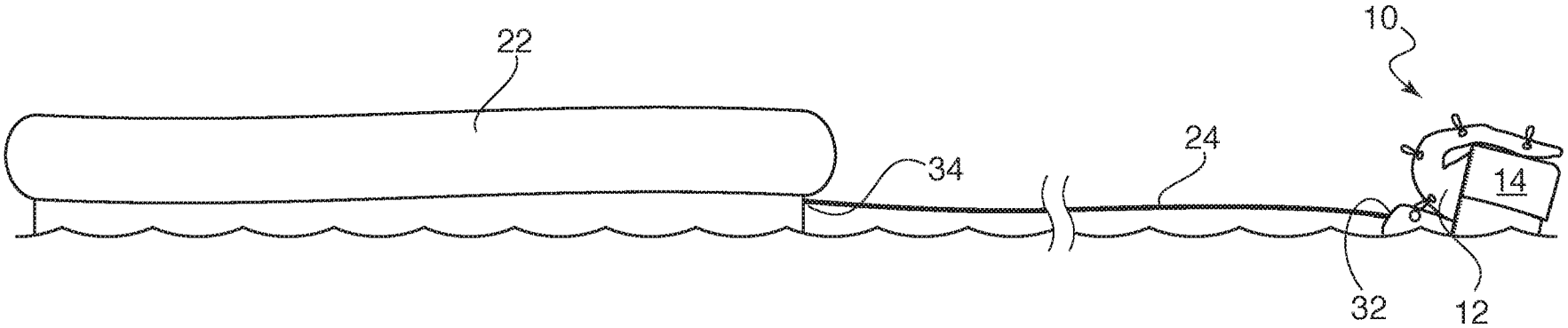
FIG. 4 shows a side plan view of the life raft deployed, with the carrying case trailing via the tether.

FIG. 4 illustrates the life raft 22 in its fully inflated condition, with the tether 24 connecting the carrying case system 10 to the life raft. A first tether securement point 32 secures the tether 24 to the raft enclosure portion 12. A second tether securement point 34 secures the tether 24 to the life raft 22. The second tether securement point 34 may be a patch with a loop that is similar to the first tether securement point loop. In other examples, the second tether securement point 34 may be a circular ring, a D-shaped ring, a snap, a hook, a grommet, a stitched cord, a hook and loop fastener, or any combination thereof. The tether 24 may be tied, looped, sewn, or otherwise secured with respect thereto. The loop may be stitched or otherwise securely secured with respect to the life raft 22. The second tether securement point 34 may be secured to an upper or lower tube of the life raft 22. The second tether securement point 34 may be secured to a side of the life raft 22. In another example, the second tether securement point 34 may be a handle of the life raft 22 to which the tether 24 is secured. It is possible for both tether securement points 32, 34 to be formed similarly (e.g., have a similar construction and be made of similar materials). In other examples, the tether securement points 32, 34 may have different configurations.

Figure 5:
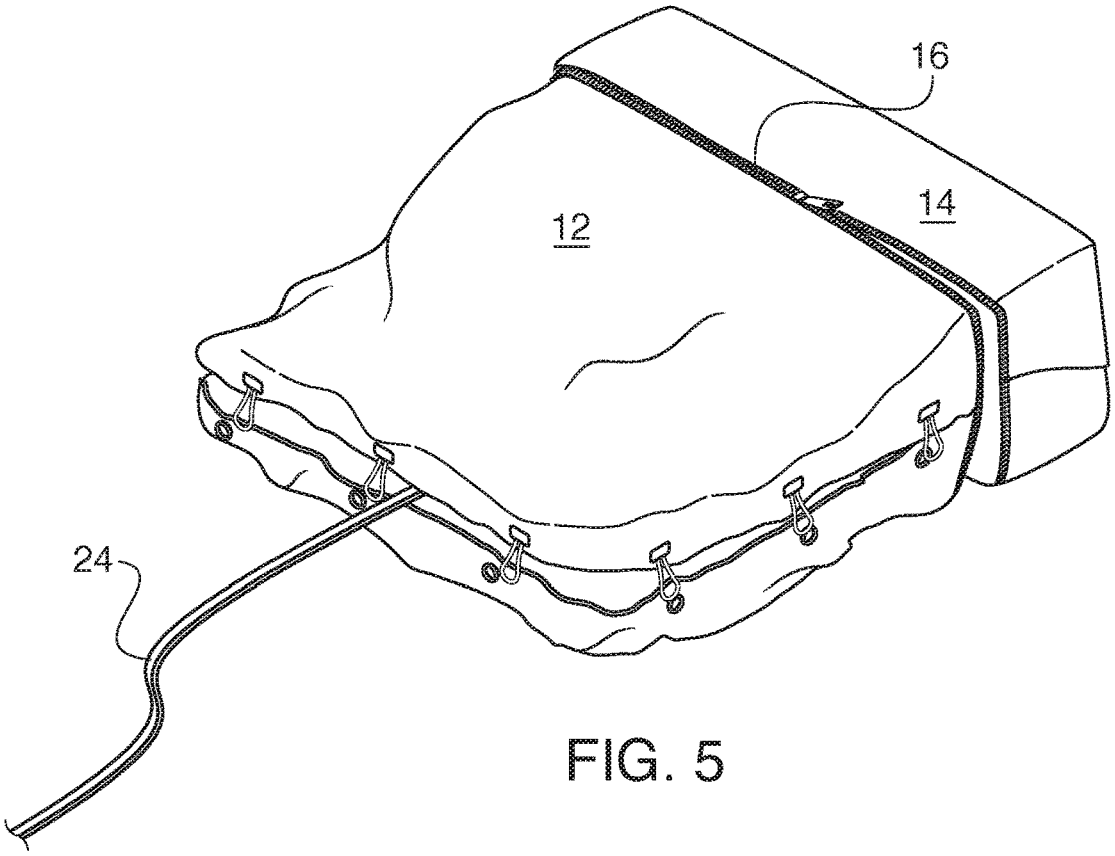
FIG. 5 shows a side perspective view of the carrying case after the life raft has been deployed, during removal of the survival kit.
Figure 6:
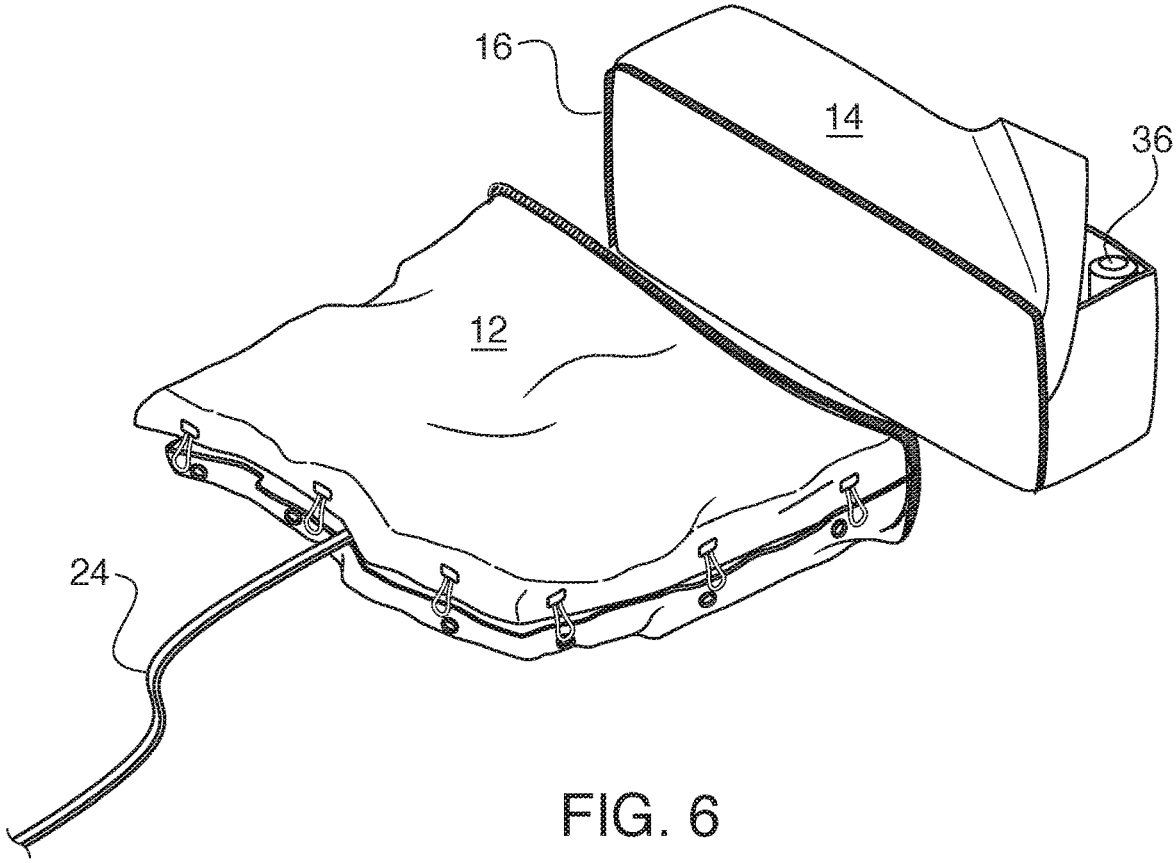
FIG. 6 shows a side perspective view of the survival kit separated from the raft enclosure portion.

Once the life raft occupants are safely settled within the life raft 22, they may pull the tether 24 in order to draw the carrying case system 10 into the life raft 22. Once the carrying case system 10 is in the life raft, the survival kit 14 may be disengaged from the raft enclosure portion 12, as illustrated by FIGS. 5 and 6. The life raft enclosure portion 12 remains secured to the life raft 22 via the tether 24, but it is no longer needed. It has simply housed the life raft 22, allowed deployment of the life raft 22, and maintained a connection between the life raft 22 and the survival kit 14 until the survival kit 14 was needed. Once the survival kit 14 has been disconnected from the raft enclosure portion 12, the life raft occupants may safely use its contents. For example, the survival kit may contain food rations, water, flares, an ELT/beacon 36 (shown in FIG. 6), first aid supplies, and any other types of survival equipment that may be necessary.

Although specific embodiments have been shown and described, it should be understood that changes and modifications, additions and deletions may be made to the structures and methods recited above and shown in the drawings without departing from the scope or spirit of the disclosure or the following claims.

What is claimed is:

1. A carrying case system for a life raft, comprising:

a raft enclosure portion and a survival kit positioned external to the raft enclosure portion, wherein the raft enclosure portion encloses a life raft and comprises a closure system that maintains the raft enclosure portion in a closed configuration until life raft deployment, wherein the closure system is opened via a release system, wherein the raft enclosure portion further comprises a first tether securement point on an internal surface of the raft enclosure portion;

wherein the life raft comprises a second tether securement point; and a tether secured to the first tether securement point and to the second tether securement point, wherein the survival kit is detachably secured via an attachment that extends a length of an external end surface of the raft enclosure portion, allowing the survival kit to be accessible without opening the raft enclosure portion but rigidly attached to the external end of the raft enclosure portion, wherein once the life raft is deployed from the raft enclosure portion, the tether maintains a connection between the life raft and the raft enclosure portion such that a user can use the tether to pull the opened raft enclosure portion into the deployed life raft and detach the survival kit from the raft enclosure portion.

2. The system of claim 1, wherein the attachment comprises a zipper.

3. The system of claim 2, wherein the zipper comprises one zipper portion generally traverses a perimeter of one end of the carrying case and another zipper portion generally traverses a perimeter of one end of the survival kit.

4. The system of claim 1, wherein the attachment comprises any combination of hooks, snaps, buckles, buttons, or hood and loop fasteners.

5. The system of claim 1, wherein the survival kit is directly secured to the raft enclosure portion, without requiring intervening or external ties or lines.

6. The system of claim 1, wherein the first tether securement point comprises a loop positioned on an internal surface of a top flap, a bottom flap, or a rear wall of the raft enclosure portion.

7. The system of claim 1, wherein the first tether securement point comprises a circular ring, a D-shaped ring, a snap, a hook, a grommet, a stitched cord, a hook and loop fastener, or any combination thereof.

8. The system of claim 1, wherein the tether is stitched, sewn or tied in place with respect to the first tether securement point.

9. The system of claim 1, wherein the raft enclosure portion comprises a closure system that is opened by force.

10. The system of claim 1, wherein the survival kit comprises water, provisions, an electronic locating transmitter (ELT), medical necessities, first aid or lifesaving items, or any combination thereof.

11. A method for packing a life raft into a carrying case, comprising:

providing the carrying case system for a life raft of claim 1;

securing the tether to the life raft;

packing the life raft into the raft enclosure portion; and attaching the survival kit to an external surface of the raft enclosure portion, wherein the survival kit is detachably secured to the raft enclosure portion without opening the raft enclosure portion.

12. The method of claim 11, wherein attaching the survival kit to the raft enclosure portion comprises zippering the survival kit to the raft enclosure portion.

13. The method of claim 12, wherein the zipper comprises one zipper portion generally traverses a perimeter of one end of the carrying case and another zipper portion generally traverses a perimeter of one end of the survival kit.

14. The method of claim 11, wherein the attachment comprises any combination of hooks, snaps, buckles, buttons, or hood and loop fasteners.

15. The method of claim 11, further comprising removing the survival kit from the raft enclosure portion in order to check or replace one or more age limited parts contained within the survival kit.

16. The method of claim 11, wherein attaching the survival kit to the raft enclosure portion occurs at a later date than packing the life raft into the raft enclosure portion.

* * * * *